United States Patent [19]

Michel

[11] Patent Number: 4,492,562

[45] Date of Patent: Jan. 8, 1985

[54] PREMIX-TYPE BURNER DISTRIBUTER TIP

[75] Inventor: Frederick A. Michel, Alvin, Tex.

[73] Assignee: Standard Oil Company (Indiana), Chicago, Ill.

[21] Appl. No.: 489,129

[22] Filed: Apr. 27, 1983

[51] Int. Cl.[3] ..... F23C 5/08

[52] U.S. Cl. ..... 431/177; 431/347; 239/568

[58] Field of Search ..... 431/171, 172, 174, 177, 431/178, 179, 347, 348, 353; 239/553, 557, 567, 568

[56] References Cited

U.S. PATENT DOCUMENTS

| | | | |
|---|---|---|---|
| 13,387 | 3/1912 | Van Zandt | 431/353 |
| 1,584,210 | 5/1926 | Brunow | 239/568 |
| 1,771,628 | 7/1930 | Grayson | 239/568 |
| 2,621,722 | 12/1952 | Abrams | 239/568 |
| 3,182,712 | 5/1965 | Zink et al. | 431/177 |
| 3,416,735 | 12/1968 | Reed | 431/347 |

*Primary Examiner*—Margaret A. Focarino

*Attorney, Agent, or Firm*—James R. Henes; William T. McClain; William H. Magidson

[57] ABSTRACT

A burner distributor tip for projecting a fuel-oxygen mixture from a premix-type gaseous fuel burning system to a refractory furnace surface is disclosed.

4 Claims, 5 Drawing Figures

PREMIX-TYPE BURNER DISTRIBUTER TIP

BACKGROUND OF THE INVENTION

1. Field of the Invention

This invention relates generally to a premix-type gaseous fuel burning system and more particularly concerns a burner distributor tip for projecting burning fuel from a premix-type gaseous fuel burning system to a refractory furnace surface which in turn radiates heat.

2. Description of the Prior Art

Furnaces which employ burners of the radiant type that are provided with distributor tips which project a premixed fuel-oxygen mixture toward a refractory furnace floor, wall or ceiling in which the burners are mounted so that the floor, wall or ceiling, respectively, can be heated by flames from the distributor tips and can in turn radiate heat are in wide commercial use, for example, in petroleum refineries, chemical or other process plants and in steam boilers in industrial plants. Such furnaces are typically employed to heat absorbing tubes or other surfaces positioned within the furnace at a distance away from the radiant refractory floor, wall or ceiling.

In such furnaces, it is extremely desirable to have a uniform distribution of heat within the furnace and to maximize fuel efficiency. Failure to do so can result in equipment damage due to excessive heating in some regions of the furnace, inadequate temperatures in other regions and excessive fuel costs. A nonuniform distribution of heat within the furnace is often the result of the use of burner distributor tips which do not maximize contact between the burning fuel-oxygen mixture projected therefrom and the refractory floor, wall or ceiling and which project the burning fuel-oxygen mixture in patterns resulting in turbulence and relatively increased convective heat transfer at the expense of relatively decreased radiant heat transfer.

OBJECTS OF THE INVENTION

Accordingly, it is a general object of the present invention to provide an improved radiant burner distributor tip which meets the aforementioned requirements and solves the aforementioned problems.

More particularly, it is an object of the present invention to provide a distributor tip for a radiant burner which projects a burning premixed fuel-oxygen mixture therefrom so as to maximize contact of the flame pattern with the refractory surface in which the burner is mounted.

It is another object of the present invention to provide a distributor tip for a radiant burner which projects a burning premixed fuel-oxygen mixture therefrom toward a predetermined region of a refractory surface in which the burner is mounted so as to maximize the efficiency and relative amount of radiant heat transfer from the refractory surface.

It is an additional object of the present invention to provide a distributor tip for a radiant burner which projects flames in a substantially continuous radial pattern therefrom.

Other objects and advantages of the invention will become apparent upon reading the following detailed description and appended claims and upon reference to the accompanying drawings.

SUMMARY OF THE INVENTION

These objects are achieved by an improvement to be employed in combination with a premixed fuel-oxygen burner which is adapted to project a burning premixed fuel-oxygen mixture to an interior surface of a furnace in which surface the burner is mountable in which surface then radiates heat to the interior of the furnace, the burner comprising a distributor tip which, when mounted in the interior surface, extends lengthwise from the furnace interior surface into the interior of the furnace and through which the fuel-oxygen mixture passes into the furnace. The improvement comprises a distributor tip comprising an end wall and a slotted cylindrical side wall extending axially perpendicularly from the interior surface and wherein a plurality of arcuate slots spaced along the length of the side wall at different distances from the interior surface when mounted in the interior surface and extending lengthwise circumferentially therein form exclusive paths for passage of the fuel-oxygen mixture into the interior of the furnace, with each slot extending through the side wall at an angle with respect to the axis of the cylindrical side wall so that all of the slots collectively direct the fuel-oxygen mixture to a predetermined region of the interior surface.

BRIEF DESCRIPTION OF THE DRAWINGS

For a more complete understanding of this invention, reference should now be made to the embodiments illustrated in greater detail in the accompanying drawings and described below by way of examples of the invention. In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWINGS INCLUDING PREFERRED EMBODIMENTS

The present invention is a burner distributor tip for use on a premix-type gaseous fuel burner of the radiant type and in conjunction with a furnace in a hole in the floor, roof or a wall of which the burner is mounted so as to heat the floor, roof or wall, respectively, so that radiant heat thereby developed therein is projected into the furnace chamber and toward material therein that is to be heated. While the fuel mixture recited hereinbelow is a mixture of fuel and oxygen, it is of course recognized that the oxygen is usually supplied in the form of air.

Figure 1:
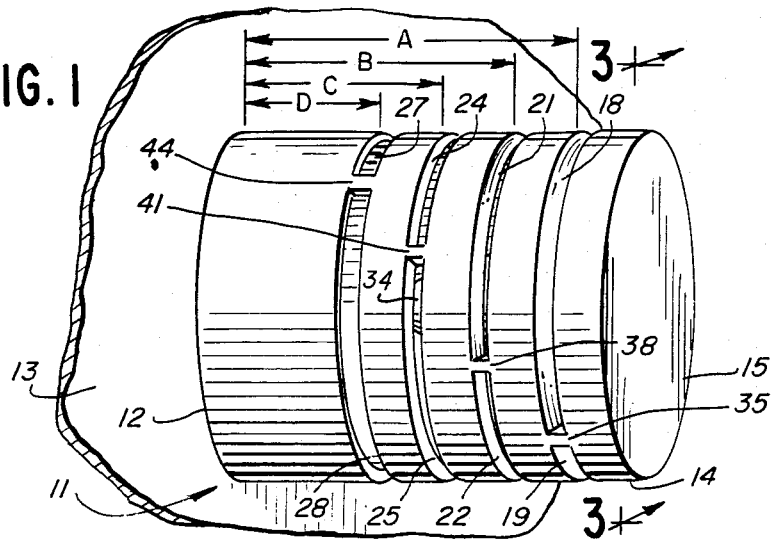
FIG. 1 is a perspective view from inside a furnace of a portion of one flat side wall of the furnace through a hole in which is mounted one embodiment of a premix-type burner distributor tip of this invention, wherein, at each of 4 distances from the furnace side wall, a plurality of slots through the distributor tip's cylindrical side wall are aligned lengthwise on the circumference of the distributor tip and collectively form a substantially continuous annular circumferential passage for the fuel-oxygen mixture from the burner distributor tip into the furnace.
Figure 2:
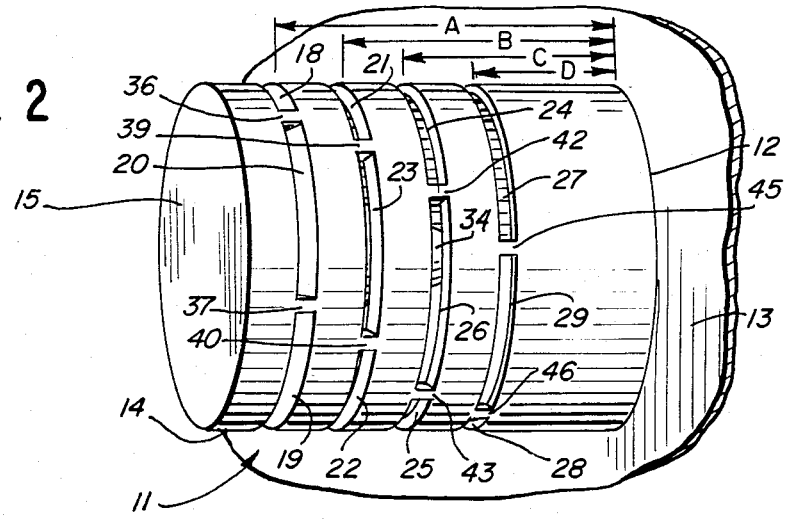
FIG. 2 is a perspective view from inside the furnace of the opposite side of the burner distributor tip shown in FIG. 1.

Although a burner distributor tip of the present invention can be mounted in one or more of the furnace floor, ceiling or walls, for the sake of convenience it will be illustrated as mounted in a furnace wall. In addition, although the surface in which the distributor tip is mounted may be of any desirable shape, it is preferably substantially flat. Referring to FIGS. 1 and 2 together, one embodiment of the improved burner distributor tip of the present invention comprises a cylindrical distributor tip 11 mounted in a circular hole 12 in a substantially flat refractory furnace wall 13. The remaining elements of the premix-type burner other than the distributor tip are conventional and are not illustrated in the figures or discussed further herein. Any convenient conventional means for mounting a burner in a furnace wall, floor or ceiling can be employed and is not shown in the drawings. The distributor tip 11 comprises a cylindrical slotted side wall 14 and an end wall 15 and is mounted in the furnace wall 13 so that the cylindrical side wall 14 extends axially perpendicularly from the furnace wall 13. Slots 18–29 in the distributor tip side wall 14 pass completely through the distributor tip side wall 14 and serve as the only passages in the distributor tip 11 through which the premixed fuel-oxygen mixture can pass into the furnace. The slots are spaced along the length of the distributor tip side wall 14 at different distances (A, B, C and D) from the furnace wall 13. The slots at each distance from the furnace wall 13—that is, the slots 18–20 at distance A, the slots 21–23 at distance B, the slots 24–26 at distance C and the slots 27–29 at distance D—extend lengthwise along the circumference of the cylindrical side wall 14 at the distance A, B, C or D, respectively, and collectively extend substantially completely around the circumference of the side wall 14 at the distance A, B, C or D, respectively. Thus, the combination of slots 18–20, 21–23, 24–26 and 27–29 at each distance A, B, C and D, respectively, from the furnace wall 13 forms a substantially continuous annular path for the premixed fuel-oxygen mixture to pass from the burner distributor tip 11 at the distance A, B, C or D, respectively, from the furnace wall 13.

Figure 3:
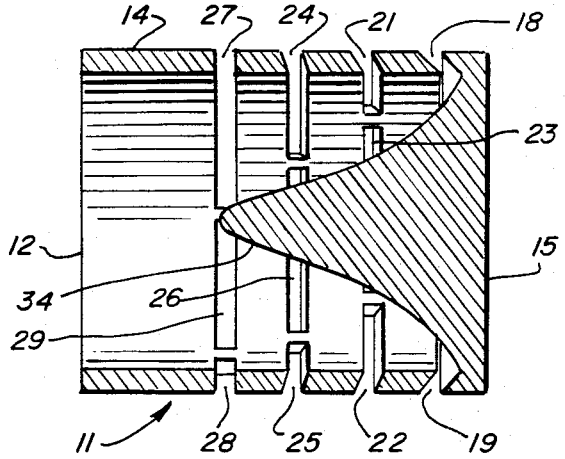
FIG. 3 is a sectional view of the burner distributor tip in FIGS. 1 and 2 taken along the plane 3—3 in FIG. 1.

Turning now to FIG. 3, it can be seen that each of the slots 18–29 is formed in the distributor tip side wall 14 at an angle with respect to the axis of the side wall 14 such that the fuel-oxygen mixture passing therethrough is directed toward a predetermined region of the furnace wall 13. Thus, in the embodiments illustrated in FIGS. 1–3, the burning fuel-oxygen mixture is directed from the distributor tip 11 uniformly from the axis of the distributor tip side wall 14 toward and into contact with a predetermined region of the furnace wall 13 where a circular flame pattern is formed with the distributor tip 11 at its center.

Although the angle of each slot 18–29 with respect to the axis of the distributor tip side wall 14 can be the same regardless of the distance A, B, C or D of the slots 18–29 from the furnace wall 13, the angle with respect to the axis of the distributor tip side wall 14 of the slots 18–20, 21–23, 24–26 and 27–29 at one distance A, B, C or D, respectively, from the furnace wall 13 can also be different from the angle with respect to the axis of the distributor tip side wall 14 of the other slots 18–20, 21–23, 24–26 or 27–29 at another distance A, B, C or D, respectively, from the furnace wall 13. It is preferred that, as in the embodiment illustrated in FIG. 3, the slots form an acute angle with respect to the axis of the distributor tip side wall 14 which decreases as the distance between the slots 18–29 and the furnace wall 13 increases in order to ensure maximum contact with the furnace wall 13 of the burning fuel-oxygen mixture projected from the slots at the greater distances from the furnace wall 13. It is also preferred that the angles with respect to the axis of the distributor tip side wall 14 of the slots relatively closer to the furnace wall 13 are relatively less acute, with the angle with respect to the axis of the distributor tip side wall 14 of the slots closest to the furnace wall 13 being as large as 90° in order to effect a more even distribution of the flame pattern from the burning fuel-oxygen mixture over the predetermined region of the furnace wall 13. Thus, preferably the slots 18–24 in the distributor tip side wall 14 are progressively angled more toward the furnace wall 13 as the distance between the slots 18–29 and the furnace wall 13 increases, as illustrated in FIG. 3.

As further illustrated in FIG. 3, the end wall 15 of the distributor tip 11 comprises a bell-shaped inner surface 34 which serves to direct the fuel-oxygen mixture flowing into the distributor tip 11 toward the slots 18–29 so as to effect a smooth transition of the direction of flow of the fuel-oxygen mixture from axial to radial and thereby to minimize turbulence in the distributor tip 11, and so as also to effect a more uniform distribution and velocity of fuel-oxygen mixture through the slots 18–29. Although the inner surface 34 of the end wall 15 is illustrated in FIG. 3 as being bell-shaped, any convenient convex or hump-shaped surface can serve as a convenient means to direct or deflect the fuel-oxygen mixture entering the distributor tip 11 toward the slots 18–29. Although such means are not essential to the distributor tip of the present invention, they are preferred.

Referring now to FIGS. 1–3 together, it is seen that the only discontinuities in each substantially continuous annular path in the distributor tip side wall 14 at each distance A, B, C and D formed by the combination of slots 18–20, 21–23, 24–26 and 27–29, respectively, at such distance are the partitions 35–37, 38–40, 41–43 and 44–46, respectively, therebetween. It has been found that if these partitions 35–46 are aligned substantially along straight lines perpendicular to the furnace wall 13, then concentrated elongated regions of reduced contact between the burning fuel-oxygen mixture and furnace wall 13 result within the predetermined region of the furnace wall 13 to which the flame pattern is intended to be projected. Such regions of reduced contact are manifested as relatively cool areas in this predetermined region and reductions in the efficiency and uniformity of radiant heat transfer from the furnace wall 13. However, when the partitions 35–37, 38–40, 41–43 and 44–46 at one distance A, B, C and D, respectively, are staggered circumferentially from the partitions 36–37, 38–40, 41–43 and 44–46 at the other distances A, B, C and D, respectively, there is no such concentration of discontinuities in the flame pattern projected on the predetermined region of the furnace wall 13. This staggered configuration of partitions is highly preferred and is illustrated in FIGS. 1 and 2.

Furthermore, although the partitions 35–46 are illustrated as unslotted portions of the integral, one-piece distributor tip side wall 14 illustrated in FIGS. 1 and 2 (and in FIGS. 4–5), they could also be pins connecting discrete ring-like or plate-like wall sections that are combined to form the distributor tip side wall 14, depending only on the manner of fabricating and assembling the distributor tip side wall 14.

The embodiment of FIGS. 1–3 wherein the burning fuel-oxygen mixture is directed radially from the distributor tip 11 is highly preferred when it is desired to project a circular flame pattern on the furnace wall 13. For example, in a furnace having a radiant wall heated by burner tips arrayed in rows and columns in the wall, distributor tips having slotted side walls of the configuration illustrated in FIGS. 1–2 are usually desired for use in all such rows and columns, except in the top row where, because of convection losses, it is usually inefficient and undesirable to project the flame pattern toward a portion of the wall above the distributor tip. For the distributor tips in such top row, convection losses of radiant heat can be reduced by directing the fuel mixture only toward portions of the furnace wall that are downward or sidewise or both from the distributor tip. Thus, for such distributor tips, slots would not be located in the uppermost part of the distributor tip's side wall.

Furthermore, regardless of the height of the distributor tips on the furnace wall, reductions in the amount of heat in the wall available for radiant transfer therefrom can arise when distributor tips are spaced too closely together on the furnace wall such that the burning fuel-oxygen mixtures projected by adjacent distributor tips impinge on one another and mix turbulently before reaching the furnace wall. To avoid such situation, it is beneficial to alternate distributor tips of the type illustrated in FIGS. 1–3 which project a flame pattern on a predetermined circular region of the furnace wall having a given radius either with distributor tips also of the type illustrated in FIGS. 1–3 but which project a flame pattern on a predetermined circular region of the furnace wall having a relatively smaller radius or with distributor tips whose side walls have slots designed to project the fuel-oxygen mixture in a different type of pattern, so that in either case the fuel-oxygen mixtures projected from adjacent distributor tips do not impinge on one another.

Figure 4:
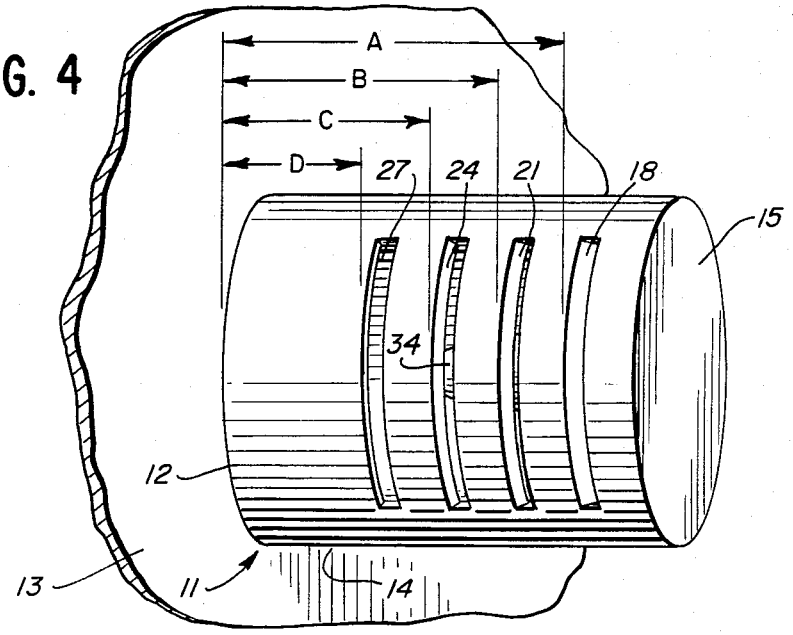
FIG. 4 is a perspective view from inside a furnace of a portion of one flat side wall of the furnace through a hole in which is mounted a second embodiment of a premix-type burner distributor tip of this invention, wherein, at each of 4 distances from the furnace side wall, 2 slots (only one of which is apparent in FIG. 4) through the distributor tip's cylindrical side wall are aligned lengthwise on the circumference of the distributor tip on opposite portions (only one of which is apparent in FIG. 4) of the side wall of the distributor tip to form 2 circumferential passages (only one of which is apparent in FIG. 4) for the fuel-oxygen mixture from opposite sides of the burner distributor tip into the furnace.
Figure 5:
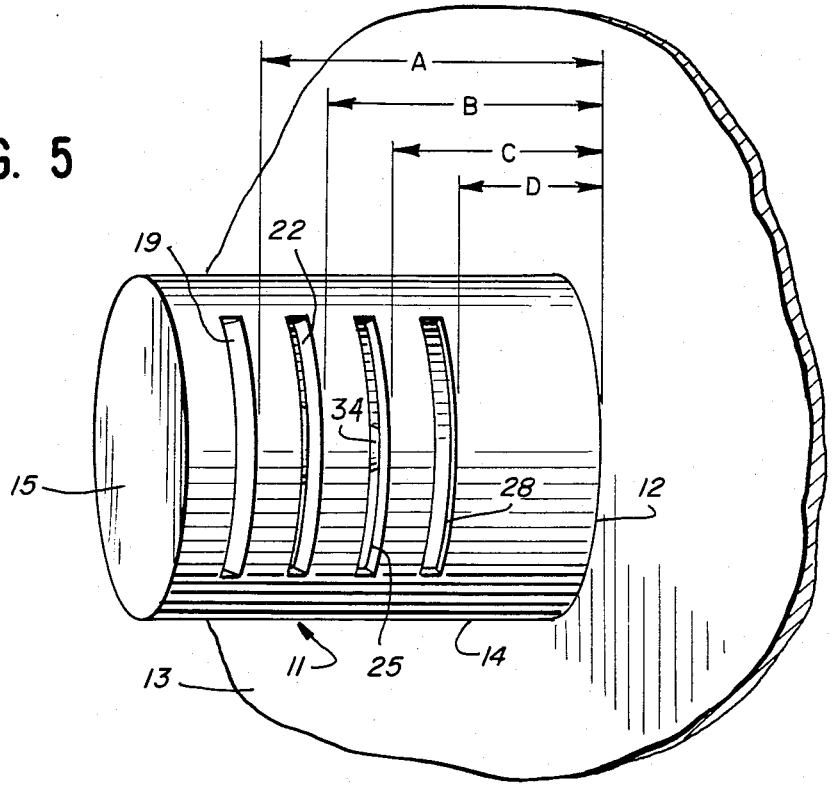
FIG. 5 is a perspective view from inside the furnace of the opposite side of the burner distributor tip shown in FIG. 4.

FIGS. 4 and 5 illustrate the opposite sides of another embodiment of the distributor tip 11 of the present invention in which the configuration of slots 18 and 19 at distance A, 21 and 22 at distance B, 24 and 25 at distance C, and 27 and 28 at distance D from the furnace wall 13 on the distributor tip side wall 14 projected a flame pattern on a predetermined region of the furnace wall 13 wherein the flame contacts the wall 13 in a pattern other than a circular pattern. Elements of the embodiment illustrated in FIGS. 4–5 which correspond to and function as elements of the embodiment illustrated in FIGS. 1–3 are numbered the same as the corresponding elements in FIGS. 1–3 and are not discussed further at this point. The fuel-oxygen mixture projected by the distributor tip illustrated in FIGS. 4–5 would contact a predetermined region of the furnace wall 13 substantially in the shape of a figure eight. Such a distributor tip 11 could be employed to heat separated portions of a furnace wall that are on opposite sides of the distributor tip 11, for example, either only above and below or only left and right of the distributor tip 11.

From the above description, it is apparent that the objects of the present invention have been achieved. It is clear from the above disclosure that distributor tips can be tailored to project a flame pattern onto a predetermined region of the furnace wall, floor or roof such that the region would have any of numerous possible shapes and such that the contact of the flame pattern with the wall, floor or roof is maximized. Thus, using distributor tips of the present invention it is possible to maximize the area of contact of the furnace radiant refractory surface with the burning fuel-oxygen mixture projected therefrom and to maximize the uniformity of such contact within such area. While only certain embodiments have been set forth, alternative embodiments and various modifications will be apparent from the above description to those skilled in the art. These and other alternatives are considered equivalents and are within the spirit and scope of the present invention.

What is claimed is:

1. In combination with a premixed fuel-oxygen burner adapted to project a burning premixed fuel-oxygen mixture to an interior surface of a furnace in which surface the burner is mountable and which surface then radiates heat to the interior of the furnace, the burner comprising a distributor tip which, when mounted in the interior surface, extends lengthwise from the furnace interior surface into the interior of the furnace and through which the fuel-oxygen mixture passes into the furnace; the improvement comprising a distributor tip comprising an end wall and a slotted cylindrical sidewall extending axially perpendicularly from the interior surface and wherein a plurality of arcuate slots spaced along the length of the side wall at different distances from the interior surface and extending lengthwise circumferentially therein form exclusive paths for passage of the fuel-oyxgen mixture into the interior of the furnace, with each slot extending through the side wall at an angle with respect to the axis of the cylindrical side wall so that all of the slots collectively direct the fuel-oxygen mixture to a predetermined region of the interior surface, and wherein the slots in the cylindrical side wall at a relatively greater distance from the interior surface of the furnace in which the distributor tip would be mounted are formed therein at a more acute angle with respect to the axis of the cylindrical side wall than are the slots in the cylindrical side wall at a relatively closer distance from the interior surface of the furnace in which the distributor tip would be mounted.

2. The improvement of claim 1 wherein the slots are so positioned and angled in the side wall of the distributor tip with respect to the axis of the cylindrical side wall as to permit projection therefrom of a fuel-oxygen mixture substantially uniformly over a predetermined region of the interior surface, when the distributor tip is mounted in the interior surface of the furnace.

3. The improvement of claim 1 wherein the inner surface of the end wall of the distributor tip comprises means to direct the fuel-oxygen mixture toward the slots in the side wall so as to permit projection therefrom of a substantially even distribution of the fuel-oxygen mixture through the slots and at a substantially uniform velocity.

4. In combination with a premixed fuel-oxygen burner adapted to project a burning premixed fuel-oxygen mixture to an interior surface of a furnace in which surface the burner is mountable and which surface then radiates heat to the interior of the furnace, the burner comprising a distributor tip which, when mounted in the interior surface, extends lengthwise from the furnace interior surface into the interior of the furnace and through which the fuel-oxygen mixture passes into the furnace; the improvement comprising a distributor tip comprising an end wall and a slotted cylindrical sidewall extending axially perpendicularly from the interior surface and wherein a plurality of arcuate slots spaced along the length of the side wall at different distances from the interior surface and extending lengthwise circumferentially therein form exclusive paths for passage of the fuel-oxygen mixture into the interior of the furnace, with each slot extending through the side wall at an angle with respect to the axis of the cylindrical side wall so that all of the slots collectively direct the fuel-oxygen mixture to a predetermined region of the interior surface and, wherein one or more aforesaid slots at each of the aforesaid different distances from the interior surface are separated from one another only by partitions therebetween and extend substantially completely around the circumference of the distributor tip, thereby forming a substantially continuous annular path for the fuel-oxygen mixture, with any partitions in the substantially continuous path at one aforesaid distance from the interior surface, when mounted in the interior surface, being staggered circumferentially from any partitions in the substantially continuous path at any other aforesaid distance from the interior surface.

* * * * *